United States Patent [19]

Ishiguro

[11] Patent Number: 4,582,969

[45] Date of Patent: Apr. 15, 1986

[54] SLIDE GUIDE CONSTRUCTION PUSH-TYPE ELECTRIC DEVICES

[75] Inventor: Osamu Ishiguro, Furukawa, Japan

[73] Assignee: Alps Electric Co. Ltd., Japan

[21] Appl. No.: 652,815

[22] Filed: Sep. 20, 1984

[30] Foreign Application Priority Data

Sep. 20, 1983 [JP] Japan ..... 58-144451[U]

[51] Int. Cl.[4] ..... H01H 13/14; H01H 3/12

[52] U.S. Cl. ..... 200/340; 200/5 A; 200/159 R

[58] Field of Search ..... 200/5 A, 5 R, 340, 159 R, 200/159 A, 159 B

[56] References Cited

U.S. PATENT DOCUMENTS

| | | | |
|---|---|---|---|
| 3,681,555 | 8/1972 | Ohkita | 200/340 |
| 4,153,829 | 5/1979 | Murata | 200/340 |
| 4,286,131 | 8/1981 | Kopish et al. | 200/340 |
| 4,297,556 | 10/1981 | Taylor | 200/330 |

*Primary Examiner*—Stephen Marcus
*Assistant Examiner*—Ernest G. Cusick
*Attorney, Agent, or Firm*—Guy W. Shoup

[57] ABSTRACT

A push-type electric device includes a case having an opening defined in a top wall thereof, and a control member slidably disposed in the case and movable therein for actuating the push-type electric device. The control member has a head projectable through the opening. The case has opposite side walls each having in an inner surface thereof a pair of slide guide grooves spaced from each other. The control member has opposite side walls each having on an outer surface thereof a pair of ridges spaced from each other and loosely fitted respectively in the slide guide grooves. Guide means are mounted on each of the ridges and extending in a direction normal to the direction in which the control member is movable in the case, the guide means being engageable with the side wall surfaces when the control member is tilted in the case.

2 Claims, 9 Drawing Figures

SLIDE GUIDE CONSTRUCTION PUSH-TYPE ELECTRIC DEVICES

BACKGROUND OF THE INVENTION

The present invention relates to a guide for the sliding element of a push-type electric device such as a pushbutton switch, and more particularly, to such a guide which allows smooth back and forth movement of the sliding element.

FIGS. 1 through 6 of the accompanying drawings illustrate one prior guide for use in a push-type electric device such as a pushbutton switch. The guide has a thin case 1 in the form of a rectangular parallelepiped having an elongate rectangular opening 1*a* defined in a top wall thereof.

A control member of knob 2 forms the sliding element of the pushbutton switch and is substantially identical in shape to the case 1. The knob 2 is slidable vertically within the case 1 and has a head 2*a* projecting out of the opening 1*a*. Fixed terminals 3 project out from the bottom of the case 1. The case 1 houses movable contacts (not shown) which may be brought into contact with fixed contacts connected to the fixed terminals 3 by sliding movement of the knob 2. The knob 2 is normally urged by return spring 4 in a direction toward the top wall of the case 1. When the knob 2 is not depressed, the movable contacts are kept out of contact with the fixed contacts.

The case 1 includes opposite longitudinal walls each having a respective pair of vertical guide grooves 5 in its inner surface for guiding back-and-forth movement of the knob 2, the guide grooves 5 of each pair being spaced from each other and extending vertically in the direction in which the knob 2 is moved.

The knob 2 includes opposite outer side surfaces facing the inner surfaces of the longitudinal walls of the case 1 and each having a pair of ridges, 6 slidably fitted in the guide grooves 5 respectively. Each of the guide grooves 5 has a width larger than the width of a corresponding one of the ridges 6, as can be seen in FIGS. 3 and 5. Such a width difference provides for any dimensional errors of the case 1 and the knob 2 formed during molding, and also prevents sluggish movement of the knob 2 in the case 1, which would otherwise take place if the ridges 6 were fitted too lightly in the guide grooves 5.

Therefore, the knob 2 is disposed in the case with the ridges 6 loosely fitted in respective guide grooves 5. The knob 2 will then smoothly move back and forth while the ridges 6 are guided by the guide grooves 5, for carrying out quick and reliable switching operation.

When the knob 2 of such a switch is depressed on a righthand portion of its head as shown in FIG. 6, the resilient force from the return spring 4 on the knob 2 becomes irregular or uneven, tending to tilt the knob 2 clockwise. At this time, the upper end of the righthand ridge 6 (as shown in FIG. 6) and the lower end of the lefthand slide ridge 6 are urged against side wall surfaces of the respective guide grooves 6. The knob 2 is now depressed in such a tilted condition.

Conversely, when the knob 2 is depressed on a lefthand portion of its head as shown in FIG. 6, the knob 2 is tilted counterclockwise. At this time, the upper end of the lefthand ridge 6 and the lower end of the righthand ridge 6 are held against side wall surfaces of the slide guide grooves 6, and the knob 2 is now depressed in such a tilted condition.

Therefore, the downward movement of the knob 2 is rendered sluggish, and the operator of the knob 2 is rendered sluggish, and the operator is not given a good feel for the operation of the switch, with the result that the switching may not be performed quickly or reliably. Further, the portions of the knob 2 which are pressed against the side wall surfaces of the grooves 6 of the case 1 are spaced apart, which tends to impose an undue moment on the knob 2 and produce increased frictional forces. For the reasons described above, the knob 2 will sometimes get stuck and not move in the case 1.

SUMMARY OF THE INVENTION

It is an object of the present invention to provide a guide for push-type electric devices which allows a slide element to move smoothly in a case no matter where it may be depressed.

According to the present invention, there is provided a guide for use in a push-type electric device, including a case having an opening defined in a top wall thereof, and a control member slidably disposed in the case and movable therein for actuating the push-type electric device. The control member has a head projectable through the opening, and the case has opposite side walls each having in an inner surface thereof a pair of respective guide grooves spaced from each other. The control member has opposite side walls which each has on an outer surface thereof a pair of ridges spaced from each other and loosely fitted respectively in the guide grooves, and guide means are mounted on each of the ridges so as to extend in a direction normal to the direction in which the control member is movable in the case, the guide means being engageable with the side wall surfaces when the control member is tilted in the case.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
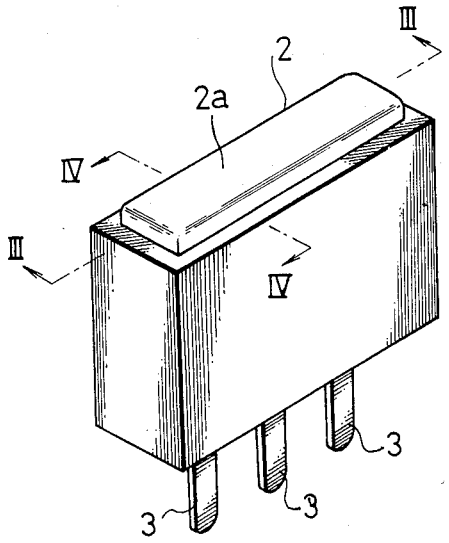
Fig.1 PRIOR ART
FIG. 1 is a perspective view of a conventional pushbutton switch of the prior art having a known guide.
Figure 2:
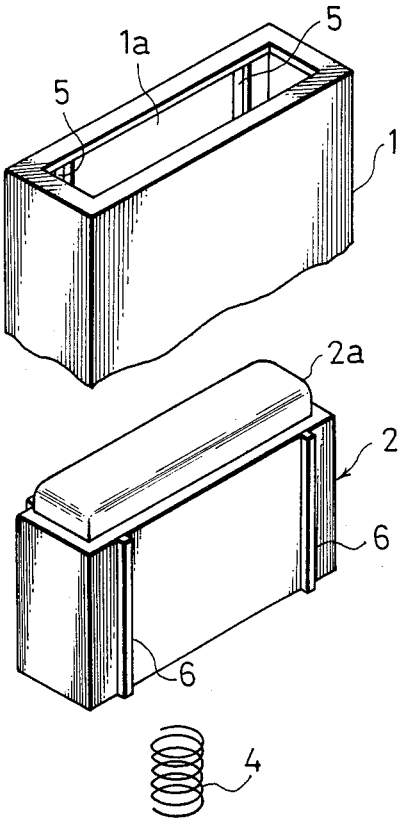
Fig. 2 PRIOR ART
FIG. 2 is an exploded perspective view of the pushbutton switch of FIG. 1, with parts omitted from illustration.
Figure 3:
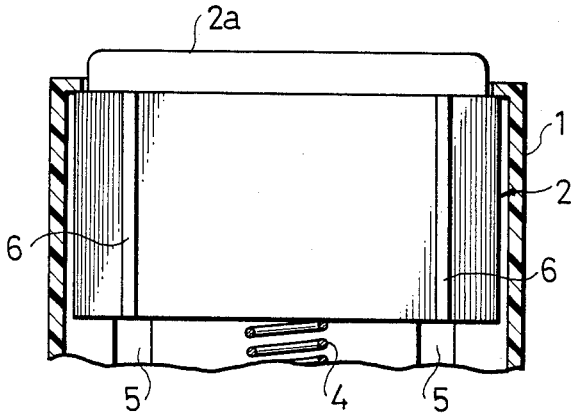
Fig. 3 PRIOR ART
FIG. 3 is a cross-sectional view taken along line III—III of FIG. 1.
Figure 4:
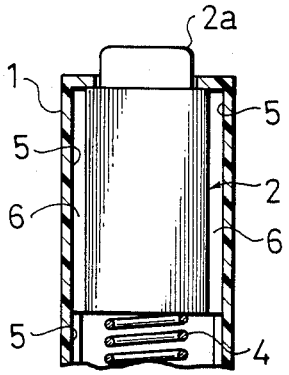
Fig. 4 PRIOR ART
FIG. 4 is a cross-sectional view taken along line IV—IV of FIG. 1.
Figure 5:
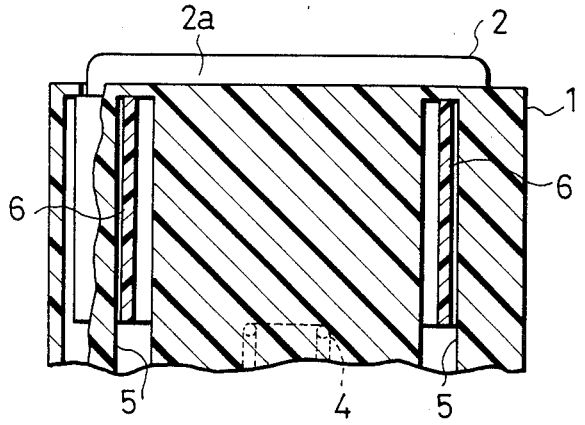
Fig. 5 PRIOR ART
FIG. 5 is a cross-sectional view of the guide construction of FIG. 2.
Figure 6:
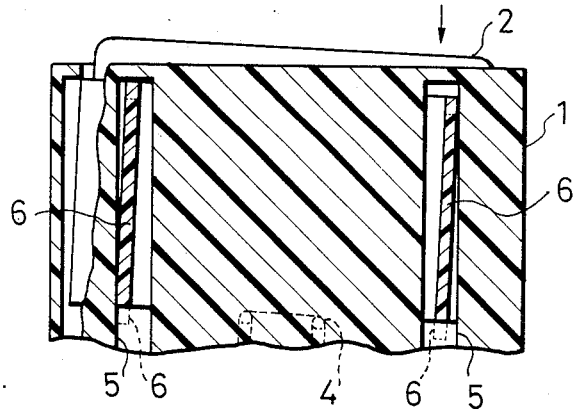
Fig. 6 PRIOR ART
FIG. 6 is a cross-sectional view of the guide construction of FIG. 2, showing an operated condition.
Figure 7:
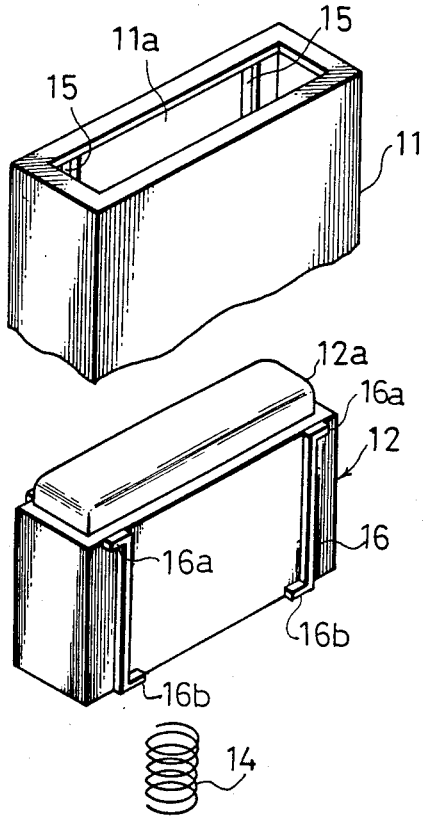
FIG. 7 is an exploded perspective view of a pushbutton switch having a guide construction according to the present invention, with parts omitted from illustration.
Figure 8:
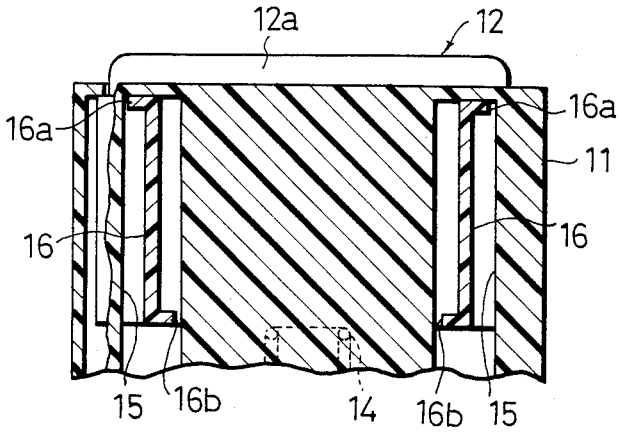
FIG. 8 is a cross-sectional view of the guide construction of FIG. 7.

A guide for use in a push-type electric device such as a pushbutton switch according to the present invention will be described with reference to FIGS. 7 through 9. The guide has a thin case 11 in the form of a rectangular parallelepiped having an elongate rectangular opening 11*a* defined in a top wall thereof.

A control member of knob 12 which is substantially identical in shape to the case 11 is slidable vertically within the case 11, and a head 12*a* of the knob 12 projected out from the opening 11*a*. Fixed terminals (not shown) project out from the bottom of case 11. The knob 12 is normally urged by a return spring 14 in a direction toward the top wall of the case 11.

The case 11 includes opposite longitudinal walls each having a respective pair of vertical guide grooves 15 in the inner surfaces thereof for guiding back-and-forth movement of the knob 12, the slide guide grooves 15 being spaced from each other and extending vertically in the direction in which the knob 12 is to be moved.

The knob 12 includes opposite outer side surfaces facing the inner surfaces of the longitudinal walls of the case 11, and each of these outer slide surfaces has a pair of slide ridges 16 slidably fitted in the respective guide grooves 15, and extending from an upper to a lower edge of the knob 2. As shown in FIG. 8, each of the ridges 16 has on its upper end closer to the top wall of the case 11 a respective outward ledge portion 16*a* projecting towards the opposite end wall of the case 11 in the direction normal to the direction of movement of the knob 12, and on its lower end closer to the bottom wall of the case 11 inward ledge portions 16*b* project towards the center of the slide walls of the case 11 in the directions normal to the direction of movement of the knob 12. Each guide groove 15 has a width slightly greater than the combined extent of the width of the ridge 16 and the lengths of the outward and inward guide ledges 16*a*, 16*b*. As a consequence, the width of the guide groove 15 is greater than that of the conventional guide groove, and has one wide wall surface closer to the end wall of the case 11.

Operation of the switch of the present invention will be described.

Figure 9:
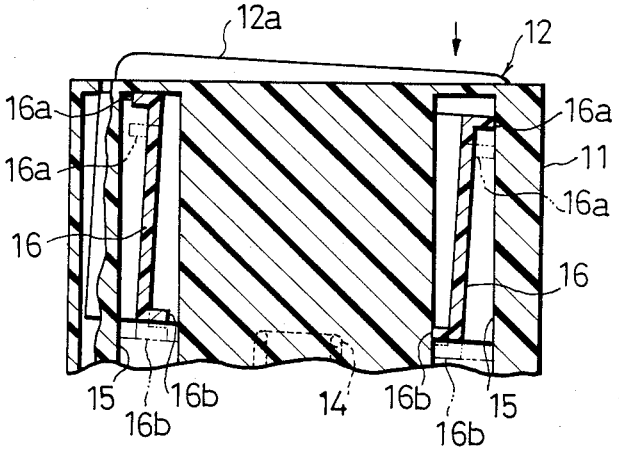
FIG. 9 is a cross-sectional view of the slide guide construction of FIG. 7, showing an operated condition.

When the knob 12 is depressed on a righthand portion of the head as indicated by the arrow in FIG. 9, the resilient force from the return spring 14 on the knob 12 becomes uneven to thereby tilt the knob 12 clockwise until the outward and inward guide ledge portions 16*a*, and 16*b* on the upper and lower ends of the righthand (FIG. 9) ridge 16 are brought into engagement with the side wall surfaces of the corresponding guide groove 15. The knob 12 is now depressed while it is tilted. At this time, the outward and inward guide ledge portions 16*a*, 16*b* on the upper and lower ends of the lefthand slide ridge are kept out of engagement with the side wall surfaces of the corresponding guide groove 15. Accordingly, the knob 12 is depressed while only the outward and inward guide ledge portions 16*a*, 16*b* of the righthand ridge 16 are being guided by the righthand guide groove 15.

Conversely, when the knob 12 is depressed on a lefthand portion of the heads, the knob 12 is tilted clockwise until the outward and inward guide ledge portions 16*a*, 16*b* on the upper and lower ends of the lefthand ridge 16 are brought into engagement with the side wall surfaces of the corresponding guide groove 15. The knob 12 is depressed while only the outward and inward guide ledge portions 16*a*, 16*b* of the lefthand ridge 16 are being guided by the righthand guide groove 15.

Therefore, when the righthand or lefthand head portion of the knob 12 is depressed, the portions of the knob 12 which are placed in sliding contact with the case 11 are close to the depressed portion thereof, and the knob 12 is guided by only one guide groove 15 on each side of the knob 12, with the consequence that no undue or excessive moment is applied to the knob 12. Any frictional forces produced are therefore reduced, and the knob 12 will move smoothly no matter where it may be depressed. The operator is given a good feel as to operation of the switch, and any switching operation can be performed quickly and reliably.

Since the present invention is achieved simply by adding the outward and inward guide ledge portions 16*a*, 16*b* to the ridges 16, a mold used to form the knob 12 remains substantially the same as the conventional mold, requiring only a slight modification. Therefore, the slide guide construction does not involve any appreciable cost increase.

The present invention is not limited to a pushbutton switch which has been shown and described above, but is applicable to other electric devices having slidable members which are moved back and forth in response to a push thereon.

Although a certain preferred embodiment has been shown and described, it should be understood that many changes and modifications may be made therein without departing from the scope of the appended claims.

What is claimed is:

1. Push-type electric device, including:

(a) a case having an opening defined in a top wall thereof;

(b) a control member slidably disposed in said case and movable therein for actuating the push-type electric device, said control member having a head projectable through said opening;

(c) said case having opposite side walls each having in an inner surface thereof a respective of pair guide grooves spaced from each other;

(d) said control member having opposite side walls each having on an outer surface thereof a pair of slide ridges spaced from each other and loosely fitted respectively in said guide grooves; and (e) guide means mounted on each of said ridges and extending in a direction normal to the direction in which said control member is movable in said case, said guide means being a guide ledge on said slide ridges engageable with said side wall surfaces when said control member is tilted in said case.

2. A slide guide construction according to claim 1, wherein said means comprises an outer guide ledge extending from an end of said ridge closer to said top wall of the case toward an end wall of said case, and an inner guide ledge extending from an end of said ridge closer to a bottom wall of the case toward a central portion of the side wall of said case.

* * * * *